US009379431B2

(12) United States Patent
Flores-Cuadras et al.

(10) Patent No.: US 9,379,431 B2
(45) Date of Patent: Jun. 28, 2016

(54) ELECTROMAGNETIC OPEN LOOP ANTENNA WITH SELF-COUPLING ELEMENT

(71) Applicants: Javier Ruben Flores-Cuadras, Tijuana (MX); Juan Alberto Saldivar-Morales, Tijuana (MX)

(72) Inventors: Javier Ruben Flores-Cuadras, Tijuana (MX); Juan Alberto Saldivar-Morales, Tijuana (MX)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 0 days.

(21) Appl. No.: 14/195,849

(22) Filed: Mar. 3, 2014

(65) Prior Publication Data

US 2014/0375516 A1 Dec. 25, 2014

Related U.S. Application Data

(63) Continuation-in-part of application No. 14/049,186, filed on Oct. 8, 2013, now abandoned.

(60) Provisional application No. 61/711,191, filed on Oct. 8, 2012.

(51) Int. Cl.

| | |
|---|---|
| ***H01Q 13/10*** | (2006.01) |
| ***H01Q 1/36*** | (2006.01) |
| ***H01Q 9/28*** | (2006.01) |
| ***H01Q 5/357*** | (2015.01) |

(52) U.S. Cl.

CPC ..... *H01Q 1/36* (2013.01); *H01Q 5/357* (2015.01); *H01Q 9/285* (2013.01)

(58) Field of Classification Search

CPC ..... H01Q 9/285; H01Q 9/28; H01Q 13/106; H01Q 21/062; H01Q 9/26; H01Q 1/36; H01Q 13/16; H01Q 21/29; H01Q 9/065; H01Q 13/085; H01Q 21/0018; H01Q 21/064; H01Q 25/02

USPC ..... 343/793, 767, 794, 795, 806, 803, 807, 343/809, 895

See application file for complete search history.

(56) References Cited

U.S. PATENT DOCUMENTS

| | | | | |
|---|---|---|---|---|
| 6,252,552 | B1 * | 6/2001 | Tarvas et al. | 343/700 MS |
| 6,343,208 | B1 * | 1/2002 | Ying | 455/575.7 |
| 7,626,551 | B2 * | 12/2009 | Chien | H01Q 5/371 343/700 MS |
| 8,044,874 | B2 * | 10/2011 | Parsche | H01Q 9/0435 343/767 |
| 8,121,544 | B2 * | 2/2012 | Shimizu | H01Q 13/10 333/21 A |
| 2001/0050651 | A1 * | 12/2001 | Grangeat | H01Q 13/106 343/767 |
| 2006/0125703 | A1 * | 6/2006 | Ma | H01Q 13/103 343/767 |
| 2007/0069955 | A1 * | 3/2007 | McCorkle | H01Q 13/106 343/700 MS |
| 2008/0252538 | A1 * | 10/2008 | Ying | H01Q 1/243 343/767 |
| 2010/0007561 | A1 * | 1/2010 | Bucca | H01Q 9/0407 343/700 MS |
| 2010/0289712 | A1 * | 11/2010 | Zheng | H01Q 1/243 343/767 |

* cited by examiner

*Primary Examiner* — Linh Nguyen
(74) *Attorney, Agent, or Firm* — Coastal Patent Law Group, P.C.

(57) ABSTRACT

An antenna is provided for the new combined GPS and GLONASS technologies in single port for tracking and navigation applications in wireless devices. The resonant mechanism is excited by an open loop structure at 1.575 GHz and 1.610 GHz, forcing the current distribution to remain at that particular portion of the antenna resulting as the primary resonator.

4 Claims, 6 Drawing Sheets

ELECTROMAGNETIC OPEN LOOP ANTENNA WITH SELF-COUPLING ELEMENT

CROSS-REFERENCE TO RELATED APPLICATIONS

This application is a continuation in part of U.S. Ser. No. 14/049,186, filed Oct. 8, 2013;

which claims benefit of priority with U.S. Provisional Ser. No. 61/711,191, filed Oct. 8, 2012;

the contents of each of which are hereby incorporated by reference.

BACKGROUND

1. Field of the Invention

This invention relates to antennas; and more particularly to antennas configured for operability among GPS and GLONASS platforms.

2. Description of the Related Art

Satellite based location services are provided by Global Positioning System (GPS) and Global Navigation Satellite System (GLONASS).

GLONASS began worldwide operation in October of 2011. As such, consumer level devices are being developed which make use of the GLONASS platform.

There is a need for GLONASS antennas for integration with forthcoming devices.

There is a further need for a GPS and GLONASS compatible antenna, capable of servicing both platforms for providing robust and selectable satellite based location services.

SUMMARY

An antenna is provided for the new combined GPS and GLONASS technologies in single port for tracking and navigation applications in wireless devices. The resonant mechanism is excited by an open loop structure at 1.575 GHz and 1.610 GHz, forcing the current distribution to remain at that particular portion of the antenna resulting as the primary resonator.

When a metallic element becomes in close proximity to the antenna, instead of being highly de-tuned, the antenna only suffers minor mismatching but continues to provide a working resonance at similar frequency.

The antenna design has a very low profile of 0.15 mm of total thickness. The antenna has a good immunity to resist detuning by nearby metal parts such as RF connectors, I/O connectors, metal shielding, batteries, proximity with human body and other high dielectric elements.

DESCRIPTION OF EMBODIMENTS

In various embodiments, an antenna is described that provides stable radiation performance across a wide bandwidth when mounted in difficult scenarios or use cases.

In one embodiment, an effective technique comprises implementing an open loop structure to force the current distribution to be kept and isolated mainly in that portion of the antenna referred to herein as a "channel".

In certain embodiments, the electromagnetic fields of the antenna resist coupling with nearby positioned elements, since the fields are kept at the open loop structure, and as a result the antenna is substantially consistent in frequency and not shifted, or detuned.

Forming the antenna on flexible body allows the antenna to conform to a surface of the device where the antenna can be placed or bent multiple times. However, in other embodiments the antenna may alternatively be developed in a rigid form.

A coax-cable may be provided for simple connectivity. Alternatively, other type of connections may be implemented such as pogo pins, spring contacts, and the like.

In certain embodiments, slots are incorporated in the antenna design for a better response and improved tuning when needed.

Figure 1:
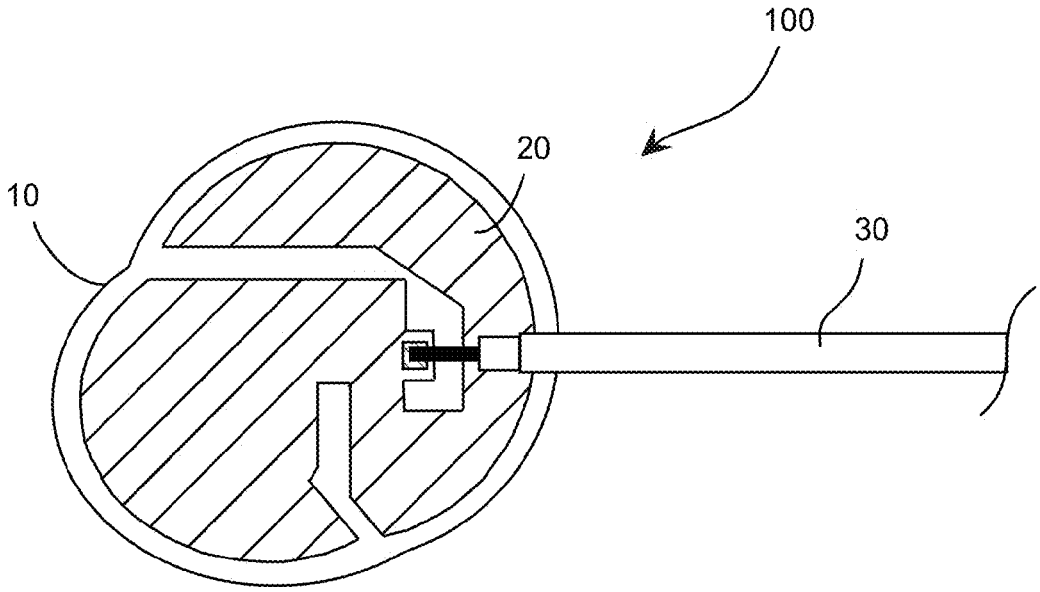
FIG. 1 shows and electromagnetic open loop antenna with a self-coupling element fixed on a flexible substrate.

FIG. 1 shows and electromagnetic open loop antenna with a self-coupling element fixed on a flexible substrate.

The antenna 100 is shown coupled to a coaxial cable 30 having a feed wire and a ground wire. The antenna comprises a monolithic conductor 20 disposed on a flexible polymer substrate 10.

Figure 2:
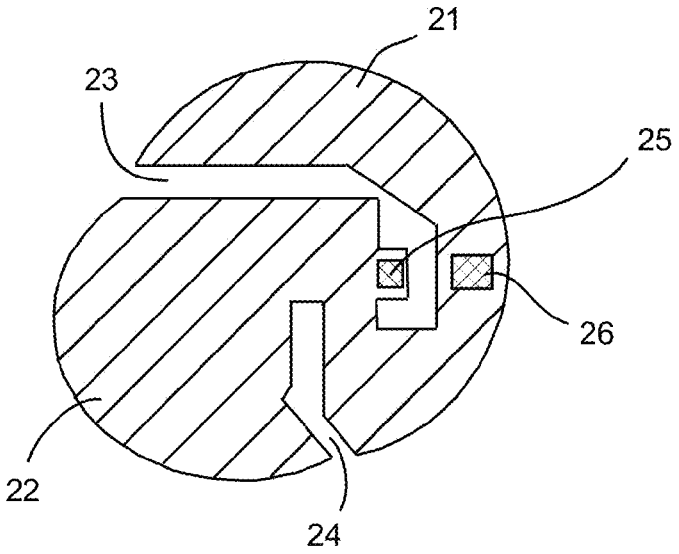
FIG. 2 shows a conductor portion of the electromagnetic open loop antenna.

FIG. 2 shows a conductor portion of the electromagnetic open loop antenna.

The conductor comprises a rounded peripheral edge extending about an outer periphery of the conductor; a center portion having four sides; a rectangular feed pad 25 extending from a first side of the center portion; a corner portion disposed adjacent to the rectangular feed pad and forming a right-angle about the first side of the center portion and a second side thereof; a first conductor portion 22 extending from a third side of the center portion opposite of the first side; a second conductor portion 21 extending from a fourth side of the center portion opposite of the second side, said second conductor portion arranged to overlap with the rectangular feed pad and the corner portion, and further configured to overlap with an edge of the first conductor portion. A channel 23 extends about three sides of the rectangular feed pad 25 and outwardly through the peripheral edge, said channel further extending around the corner portion and separating the second conductor portion 21 from the first conductor portion 22. A tuning slot 24 extends outwardly from the center portion to the peripheral edge, the tuning slot is disposed between the first and second conductor portions 21; 22, respectively.

Figure 3:
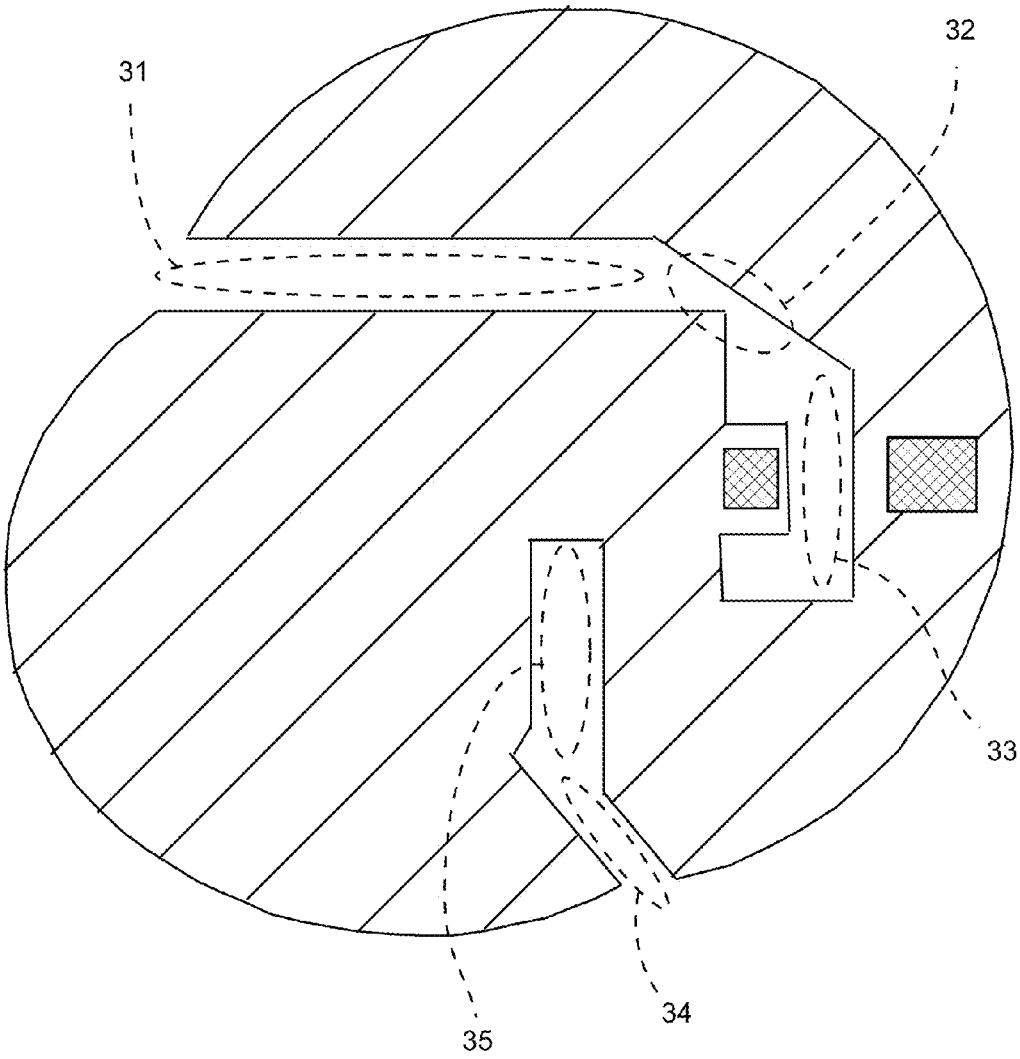
FIG. 3 further shows an expanded view of the conductor portion associated with the antenna.

FIG. 3 further shows an expanded view of the conductor portion associated with the antenna.

The conductor portion further comprises a first isolated region 33 disposed between the second conductor portion and the rectangular feed pad; a gap 32 disposed between the corner portion and a diagonal edge; and a second isolated region 31 disposed along the channel between the first and second conductor portions.

The conductor additionally comprises a tuning slot having a first tuning region 35 extending from the center portion, and a second tuning region 34 extending from the first tuning region 35 to the periphery of the conductor. The second tuning region is oriented at an angle with respect to the first tuning region; the angle is less than ninety degrees.

Figure 4:
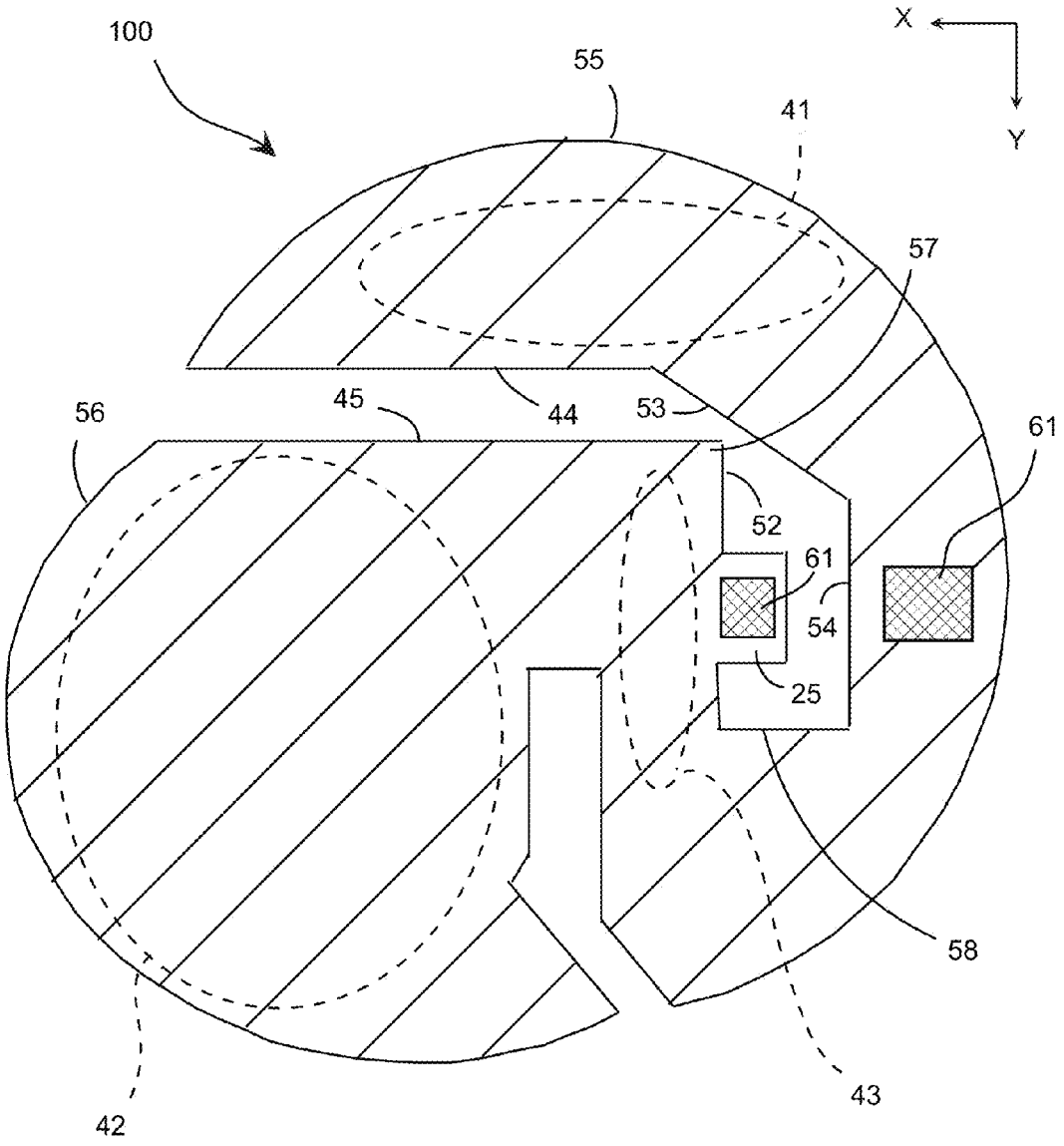
FIG. 4 shows details of the antenna and structural elements thereof.

FIG. 4 shows details of the antenna and structural elements thereof.

The antenna 100 comprises a monolithic planar conductor comprising: a rounded peripheral edge 55; 56 extending about an outer periphery of the conductor; a center portion 43 having four sides; a rectangular feed pad 25 extending from a first side of the center portion; a corner portion 57 disposed adjacent to the rectangular feed pad and forming a right-angle about the first side 52 of the center portion and a second side thereof; a first conductor portion and a first radiating portion 42 associated therewith extending from a third side of the center portion opposite of the first side; a second conductor portion and a second radiating portion 41 associated therewith extending from a fourth side of the center portion opposite of the second side, said second conductor portion arranged to overlap with the rectangular feed pad 25 and the corner portion 57, and further configured to overlap with an edge of the first conductor portion 45. The conductor further comprises a channel extending about three sides of the rectangular feed pad 25 and outwardly through the peripheral edge 56, said channel further extending around the corner portion 57 and separating the second conductor portion 44 from the first conductor portion 45 at respective first and second edges thereof. A tuning slot extends outwardly from the center portion to the peripheral edge, the tuning slot being disposed between the first and second conductor portions.

Figure 5:
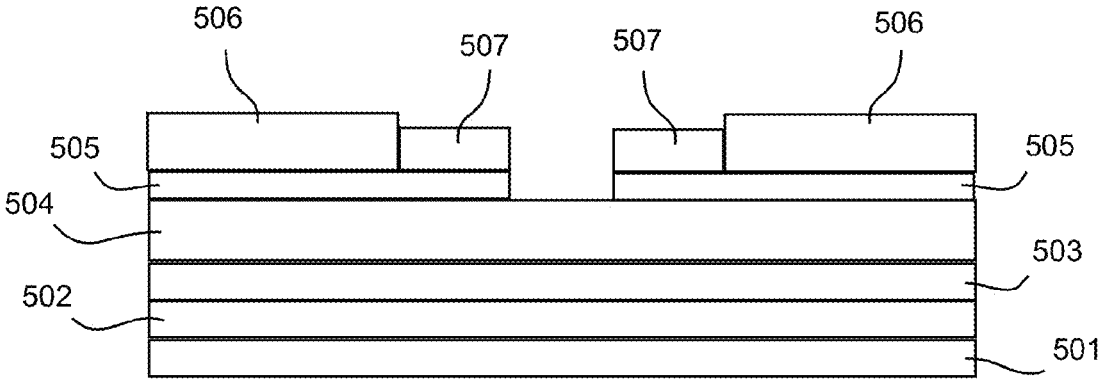
FIG. 5 shows a section view of the antenna illustrating multiple layers thereof.

FIG. 5 shows a section view of the antenna illustrating multiple layers thereof.

In an embodiment, from the bottom going upward through the cross section, the antenna comprises a liner 501; an adhesive layer 502; a bottom solder mask 503; a flexible polymer 504; a first conductor 505, for example copper; a top solder mask 506; and a second conductor 507, for example tin or gold.

Figure 6:
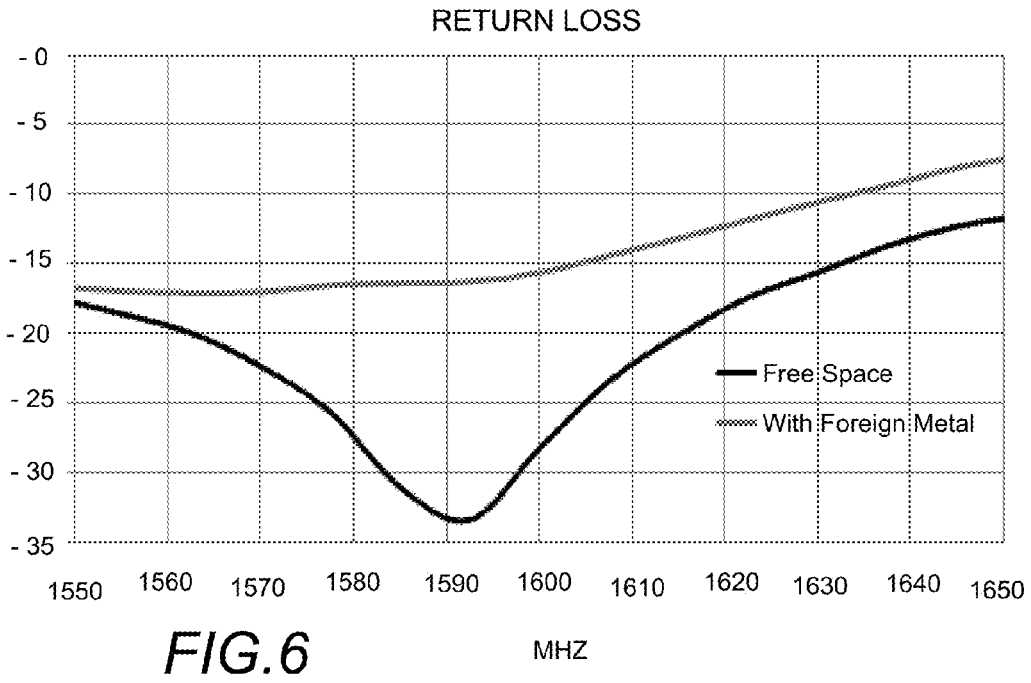
FIG. 6 shows a plot of return loss associated with the antenna in one embodiment.

FIG. 6 shows a plot of return loss associated with the antenna in one embodiment.

Figure 7:
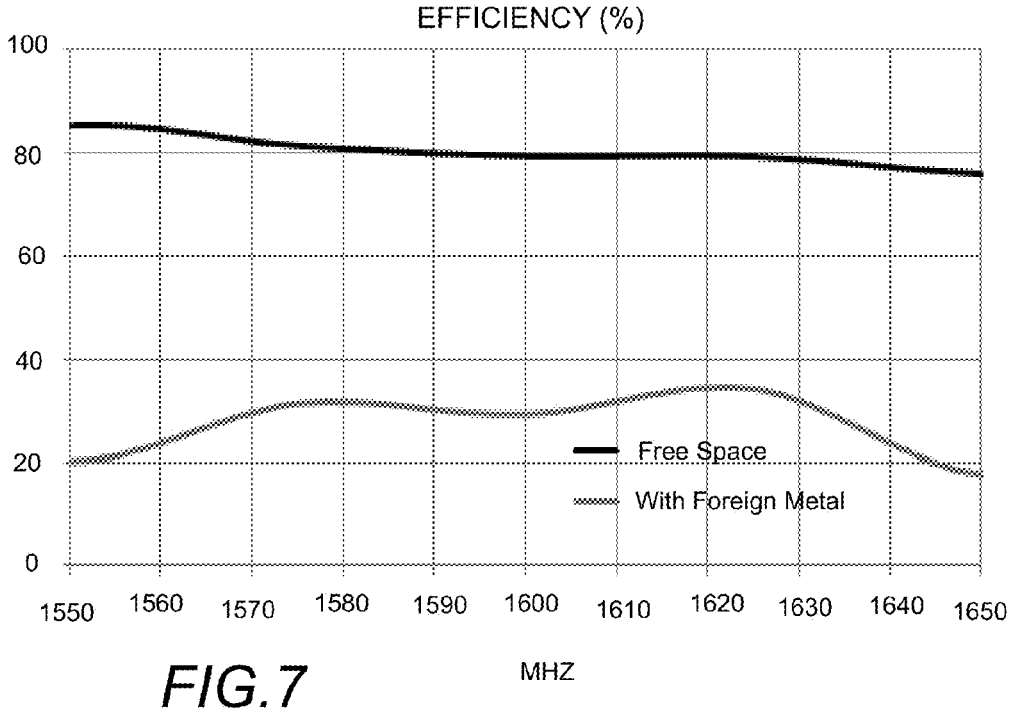
FIG. 7 shows a plot of efficiency associated with the antenna in one embodiment.

FIG. 7 shows a plot of efficiency associated with the antenna in one embodiment.

Figure 8:
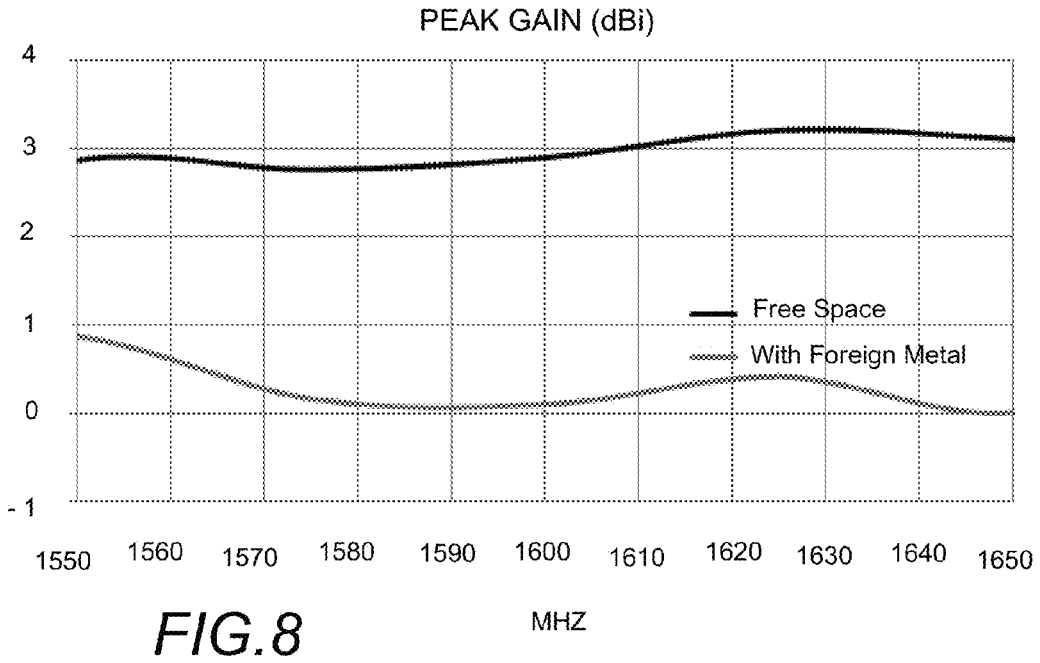
FIG. 8 shows peak gain associated with the antenna in one embodiment.

FIG. 8 shows peak gain associated with the antenna in one embodiment.

Figure 9:
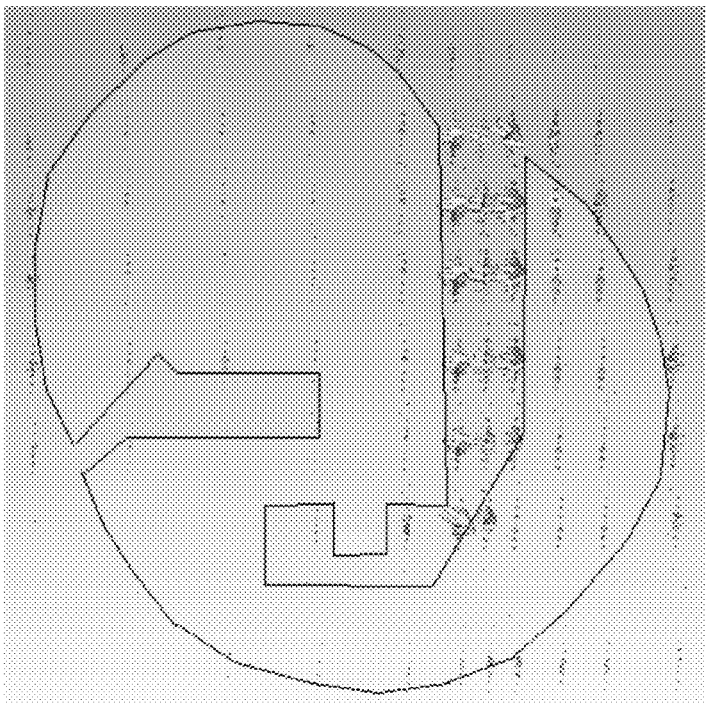
FIG. 9 shows electromagnetic fields concentrated within a primary radiating portion of the antenna for enhanced isolation from nearby components or human detuning effects.

FIG. 9 shows electromagnetic fields concentrated within a primary radiating portion of the antenna for enhanced isolation from nearby components or human detuning effects.

LIST OF REFERENCE CHARACTERS (10) flexible polymer substrate
(20) monolithic planar conductor
(21) second conductor portion
(22) first conductor portion
(23) channel
(24) tuning slot
(25) rectangular feed pad
(26) ground pad
(30) coaxial cable
(31) second isolated region
(32) gap
(33) first isolated region
(34) second tuning slot region
(35) first tuning slot region
(41) second radiating portion
(42) first radiating portion
(43) center portion
(44) first edge
(45) second edge
(52) first side of center portion
(53) diagonal edge
(54) opposing edge
(55) second peripheral edge portion
(56) first peripheral edge portion
(57) corner
(58) terminal edge
(61) solder
(100) antenna
(501) liner
(502) adhesive
(503) bottom solder mask
(504) flexible polymer
(505) first conductor
(506) top solder mask
(507) second conductor

What is claimed is:

1. An electromagnetic open loop antenna, comprising:

a monolithic planar conductor comprising:

a rounded peripheral edge extending about an outer periphery of the conductor;

a center portion having four sides;

a rectangular feed pad extending from a first side of the center portion;

a corner portion disposed adjacent to the rectangular feed pad and forming a right-angle about the first side of the center portion and a second side thereof;

a first conductor portion extending from a third side of the center portion opposite of the first side;

a second conductor portion extending from a fourth side of the center portion opposite of the second side, said second conductor portion arranged to overlap with the rectangular feed pad and the corner portion, and further configured to overlap with an edge of the first conductor portion;

a channel extending about three sides of the rectangular feed pad and outwardly through the peripheral edge, said channel further extending around the corner portion and separating the second conductor portion from the first conductor portion; and a tuning slot extending outwardly from the center portion to the peripheral edge, the tuning slot being disposed between the first and second conductor portions; and a flexible polymer substrate;

wherein said conductor is formed on said flexible polymer substrate.

2. The antenna of claim 1, said second conductor portion comprising a diagonal edge arranged tangent to the corner portion and separated therefrom to form a gap.

3. The antenna of claim 2, wherein said channel forms a ninety degree turn thorough said gap.

4. The antenna of claim 1, said second conductor portion further comprising a ground pad disposed between said peripheral edge and said rectangular feed pad.

* * * * *